US005095178A

United States Patent [19]

Hollingsworth

[11] Patent Number: 5,095,178

[45] Date of Patent: Mar. 10, 1992

[54] ELECTRICAL CONNECTOR AND METHOD

[75] Inventor: Elmont E. Hollingsworth, Austin, Tex.

[73] Assignee: Minnesota Mining and Manufacturing Company, St. Paul, Minn.

[21] Appl. No.: 632,188

[22] Filed: Dec. 21, 1990

[51] Int. Cl.[5] ..... H01R 4/10

[52] U.S. Cl. ..... 174/94 R; 29/871; 29/873; 174/71 R; 174/90; 403/209; 403/285; 403/305

[58] Field of Search ..... 174/71 R, 79, 90, 94 R; 29/518, 868, 871, 872, 873; 403/206, 209, 274, 281, 285, 278, 305, 391; 24/115 A, 129 W

[56] References Cited

U.S. PATENT DOCUMENTS

| | | | |
|---|---|---|---|
| 557,037 | 3/1896 | Toquet | 174/84 C |
| 813,538 | 2/1906 | Troll | 403/391 X |
| 1,933,555 | 11/1933 | Jasper | 174/87 |
| 2,145,040 | 1/1939 | Cawthra | 174/94 R X |
| 2,327,651 | 8/1943 | Klein | 174/71 R |
| 2,656,204 | 10/1953 | Blomstrand | 174/87 |
| 2,681,439 | 6/1954 | Carlson | 439/730 |
| 2,890,266 | 6/1959 | Bollmeier | 174/87 |
| 3,012,219 | 12/1961 | Levin et al. | 171/87 |
| 3,338,608 | 8/1967 | Burns et al. | 174/71 R |
| 3,453,375 | 7/1969 | Lundergan | 174/72 R |

FOREIGN PATENT DOCUMENTS

| | | | |
|---|---|---|---|
| 872790 | 7/1961 | United Kingdom | 174/71 R |
| 1390915 | 4/1975 | United Kingdom . | |
| 1603297 | 11/1981 | United Kingdom . | |

*Primary Examiner*—Morris H. Nimmo

*Attorney, Agent, or Firm*—Gary L. Griswold; Walter N. Kirn; John C. Barnes

[57] ABSTRACT

An electrical connector which is adapted to join two or more wires together and comprises a pair of hollow cylinders joined together and disposed such that one end portion of each cylindrical is free to be bent back upon itself after a wire is inserted therein to make good contact between the cylinder and the wire.

5 Claims, 3 Drawing Sheets

ELECTRICAL CONNECTOR AND METHOD

BACKGROUND OF THE INVENTION

1. Field of the Invention

The present invention generally relates to a wire connector, and more particularly to an improved wire splice connector for readily and easily joining a pair of wires including a solid conductor or strands of conductors.

2. Description of the Prior Art

This invention is concerned with solderless wire connectors such as may be used for splicing or making permanent connections between either bare or insulated wires or both. Connectors fitting this general description are in common use and include for example wire nut connectors, other connectors which twist wires together, connectors employing clamping spring devices, connectors having a ferrule which is crimped onto the wire, and insulation displacement connectors.

Connectors which fall in the general category of wire nut connectors are usually designed to accept and connect several wires. The ends of the wires to be connected must be bare, i.e. the ends are stripped free of electrical insulation. This allows intimate contact between the wires to be joined when the wire nut connector is applied. The use of wire nuts is limited to the formation of pigtail connections. Also wire nuts must be of a size and design to receive a desired number of wires having a specified wire gauge size. U.S. Pat. Nos. 1,933,555 (C. H. Jasper), 2,656,204 (J. H. Blomstrand) and U.S. Pat. No. 2,890,266 (E. W. Bollmeier) describe a variety of wire nut connectors useful for making pigtail splices. In this type of splice the individual wires are twisted together and electrical contact is maintained because the wire nut holds the wires in a twisted intertwined condition.

Other types of connection may be made which also rely upon the twisting of wires. In one presently known example, a metal tube, of essentially a FIG. 8 cross-section, is used to connect wires which are inserted from opposite ends of the tube. After the wires are inserted, the ends of the tube may be gripped and a turning force applied. One end of the tube is turned in a clockwise direction while the other end of the tube is held stationary. This causes the tube to adopt a helical appearance and in the process, the wires and the tube become twisted together. Often it is difficult to retain the wires in the twisted tube connector until the twisting process is complete. This is due to the fact that both hands are required to apply pressure to the tube for twisting the wires and developing the helical appearance to complete the connection. Further, this type of connector works on only one or two wire sizes, so different sized connectors must be inventoried.

In the use of wire nut or twisted tube connections the wires are first stripped of insulation after which the electrical connection is made using a twisting action and causing the wires to become intertwined.

British Patent GB 1,603,297 describes an electrical terminal device which relies upon a clamping spring to establish and maintain contact with the electrical wire. Once applied the spring clamp grips the wire and maintains its hold because it bites into the wire forming a groove in the wire surface which locks the clamp in place.

Crimp connectors are used to splice a wire to a terminal. They comprise a ferrule on a terminal into which a wire end is placed and the ferrule is flattened or crimped onto the wire as taught in U.S. Pat. No. 2,681,439. Also there are crimp connectors which are hollow tubes, and the ends of the wires to be joined are inserted into opposite ends of the tube and the tube is crimped down onto the wire ends.

In a similar fashion another form of connector, generally referred to as an insulation displacement connector, utilizes a contact with a U-shaped slot which has wall members which penetrate the insulation of the wire to make intimate contact with the conductor. An example of an insulation displacement connector is provided by U.S. Pat. No. 3,012,219 (E. J. Levin et al).

The main disadvantage of spring connectors and insulation displacement connectors lies in the fact that the attachment between wire and connector occurs only at one or two points on the surface of the wire. There is a danger that, if the point of contact is disturbed in some way, the electrical integrity of the connection will ultimately suffer. Further, the spring connectors, insulation displacement connectors, and crimp connectors do not have good pull out resistance and generally separate provision for strain relief has to be built into the connector.

The disadvantages, mentioned above, regarding prior art connectors may be avoided using the present invention. Not only is a new and novel connector provided but a novel method for increasing the area of contact between the wires and the connector. Further, the present invention is equally effective in developing either pigtail connections or in-line connections. Also the connectors of this invention may be selected of suitable size to receive either single or multiple wires in the bore of a given tube. Ultimately the development of an electrical connection is accomplished without the use of sophisticated tools or processes. A common pliers can be used to effect the bending of the cylinder containing the wire or wires to complete the connection.

SUMMARY OF THE INVENTION

The present invention relates to a device for connecting wires, having either solid or stranded conductors, so as to produce a connection which efficiently transfers electricity.

The connector of the present invention affords the joining of a plurality of wires and comprises a body having a pair of hollow tubes or cylinders formed of an electrically conductive ductile metal material which is different than the material of the wire conductor. The cylinders have an inside diameter to receive an end of at least one wire, to be joined to another wire. Means are provided for joining said cylinders electrically and preferably rigidly, such that an end portion of each cylinder is free from contact with the other cylinder whereby said end portion may be folded upon itself to make intimate contact with a wire disposed in the cylinder.

If the wires are solid wires, they are inserted with insulation in place or in an uninsulated condition. After one wire, or multiple wires, are placed inside a hollow cylinder of the connector a turning force is applied which bends the end portion of the cylinder containing the wire back upon itself until a significant bending or kinking of the cylinder is achieved. The bending action causes the cylinder to distort and kink at one or more points about the bend radius. This causes a narrowing of the bore of the tube and causes it to grip the conductor of the wire disposed therein and to make a good electrical connection and to hold the wire securely.

The method of making a connection between two or more wires comprises the steps of providing a pair of hollow cylinders formed of an electrically conductive metallic material, which are joined together such that end portions of the cylinders are free from each other, placing an end of a wire to be connected within a cylinder, and then bending or folding the end portion of the cylinder through an angle to bind the wire conductor in the cylinder.

BRIEF DESCRIPTION OF THE DRAWING

The present invention will be further described hereinafter with reference to the accompanying drawing wherein.

DESCRIPTION OF THE PRESENTLY PREFERRED EMBODIMENTS

Figure 1:
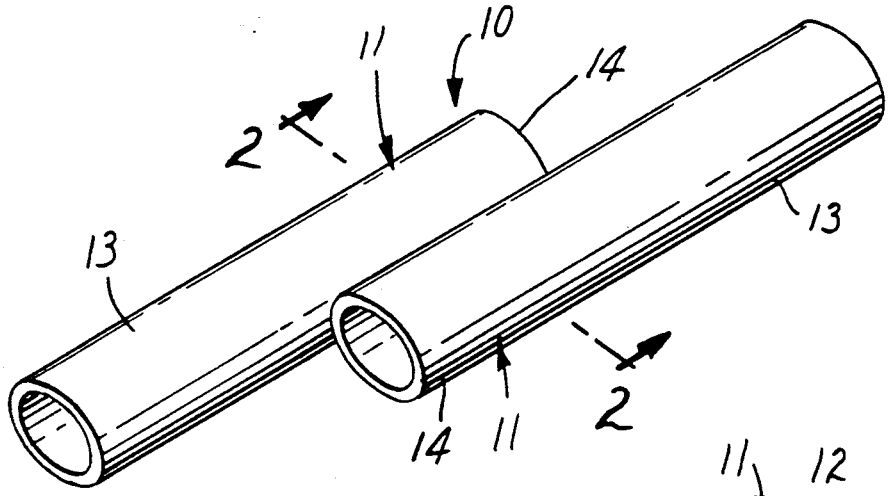
FIG. 1 is a perspective view of an embodiment of a connector according to the present invention.
Figure 2:
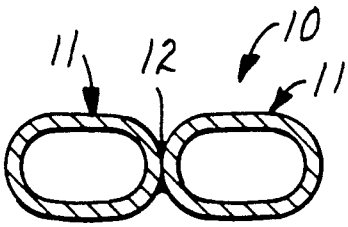
FIG. 2 is a cross-sectional view of the connector of FIG. 1, taken along the line 2—2.
Figure 3:
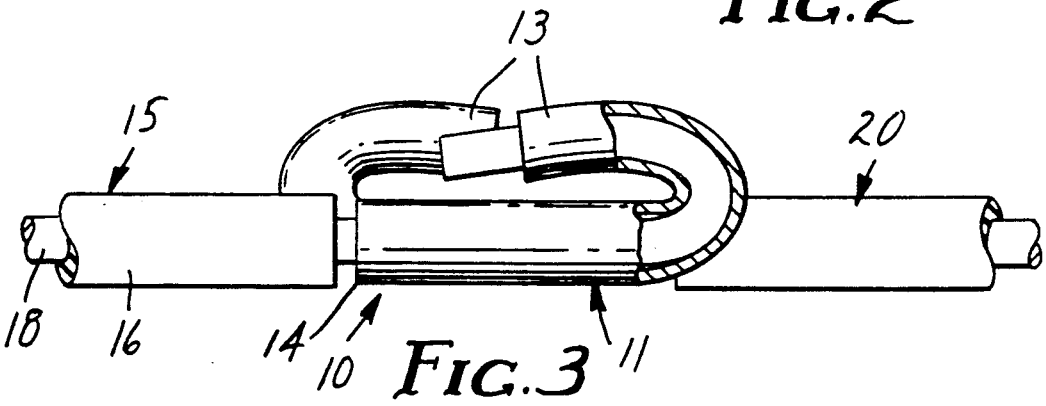
FIG. 3 is a side elevational view of a connector according to FIG. 1 having wires connected in the connector.

The connector of the present invention will now be described in greater detail with reference to the accompanying drawing wherein like reference numerals refer to like parts throughout the several views. Referring to FIGS. 1, 2 and 3, the connector 11 comprises a pair of electrically conductive hollow tubes or cylinders 11 which are joined together by means affording a fixed electrical connection therebetween. The cylinders Il are illustrated as slightly oval shaped, but they can be round or ellipsoidal in cross section and will be considered cylinders for the purpose of this description.

One important aspect is that the cylinders are joined together and a length on each cylinder extends beyond an area at which each cylinder is joined to the other. Means are provided for joining the cylinders together. They are joined in a fixed relationship. As illustrated in FIG. 1, the cylinders 11 are parallel and they are offset axially or longitudinally to space an end past a weldment or solder joint 12 which joins juxtapositioned portions of the cylinders together. The extended length or end portion 13 of each cylinder has sufficient length to be bent or folded back upon the remainder of the cylinder to a degree sufficient to make a bend in the cylinder binding a wire end in the cylinder.

Each cylinder 11 has a wire entrance end 14 and an inside dimension to receive therethrough an end of an electrical wire 15 which is to be joined to another wire or wires electrically to form a splice therebetween. The outside diameter of the wire, with or without the insulation does not have to be equal, or nearly equal to the inside diameter of the cylinder 11, since a cylinder with an inside diameter of 0.3 cm and an outside diameter of 0.5 cm is capable of making a good connection with 10 to 26 AWG wires.

As illustrated in FIG. 3 the wire 15 comprises an insulative sleeve 16 over a solid conductor 18, which insulative sleeve 16 has been at least partially removed to expose an end of bare conductor 18 which is adapted to be placed through the cylinder. Subsequently, the end portion 13 of the cylinder 11 is folded back upon itself as illustrated in FIG. 3 to tightly and elastically press the conductor 18 into intimate contact with the inside of the cylinder and make good electrical contact therewith. The folded cylinder 11 also affords very good strain relief to restrict pull out of the wire free from the connector. This pullout force will exceed 90% of the tensile strength of the wire alone. A second wire 20 is stripped at its end and inserted through the second cylinder 11 of the connector in the opposite direction and it is folded back upon itself to make electrical connection to the second wire and complete the splice between the conductors of the two wires.

The cylinders illustrated are formed of a ductile electrically conductive metallic material, for example, cartridge brass, soft or dead soft. The metal material is different than the material of the conductors. For example the cylinders 11 are made of brass or a brass alloy, the conductors are copper, and this difference in material gives strength to the connection since the two materials do not have the same tensile strength or elasticity.

The cylinders 11 are joined together as by brazing, to form the web 12 between the cylinders or a bridge piece may be joined to the cylinders 11 by weldments, depending on the material, to join the cylinders electrically and mechanically, between the central portions of each cylinder and/or wire entrance the end portions next adjacent and opposite the oppositely extended end portions 13 of the cylinders. The material of the cylinders when kinked, due to the folding of the end portion 13, provides a compressive force against the conductor 18 and maintains contact thereafter.

Figure 4:
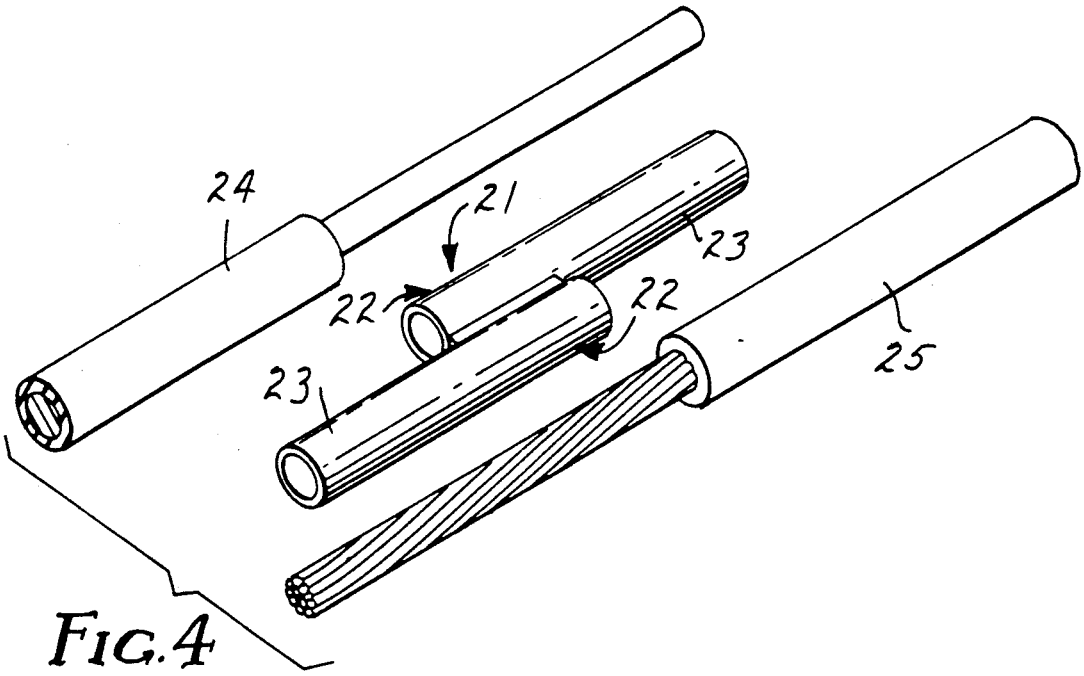
FIG. 4 is a perspective view of a second embodiment of a connector together with perspective views of two lengths of wire to be connected together, one solid and one stranded.
Figure 5:
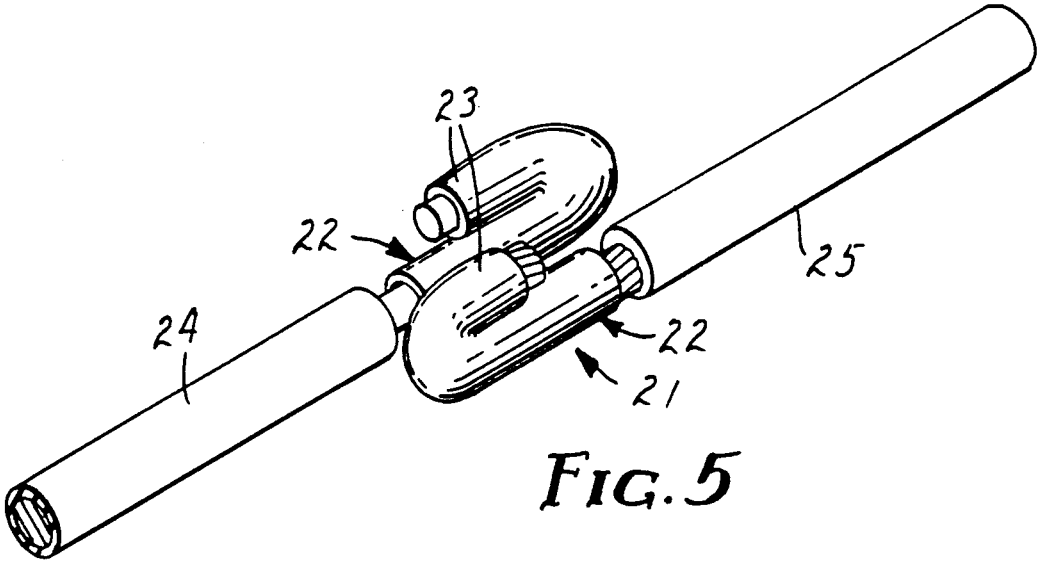
FIG. 5 is a perspective view of the wire ends connected together with end portions of the connector bent upon itself to contact the wire.

The connector 21 of FIG. 4, comprises a pair of right circular cylinders 22 which are brazed together to provide the offset end portions. Two wires 24 and 25 are also illustrated, which are stripped at their ends for connection by the connector 21. The wire 24 is a solid wire to be joined with one cylinder 22 and the wire 25 is a stranded wire which may be connected to the solid wire in the second cylinder 23. As illustrated in FIG. 5, when the end portions 23 are bent the wires are also folded and are tightly joined in the kinks of the cylinders as they are folded.

The method of the present invention is illustrated in FIGS. 4 and 5 and comprises the steps of placing an end of a wire 24 to be connected within a hollow tube or cylinder, and then bending or folding an end portion of the tube through an angle to bind the wire conductor in the tube.

It is preferred that the ends of the wires be stripped of the outer insulation layer covering the conductor before insertion into the cylinder of the connector. When connecting wires with solid conductors, the wire need not be stripped since the folding of the cylinder may make a sharp kink in the side wall causing the cylinder to squeeze the insulation to such an extent than it is displaced and the conductor becomes exposed and placed in intimate electrical contact with the interior walls of the connector cylinder.

Figure 6:
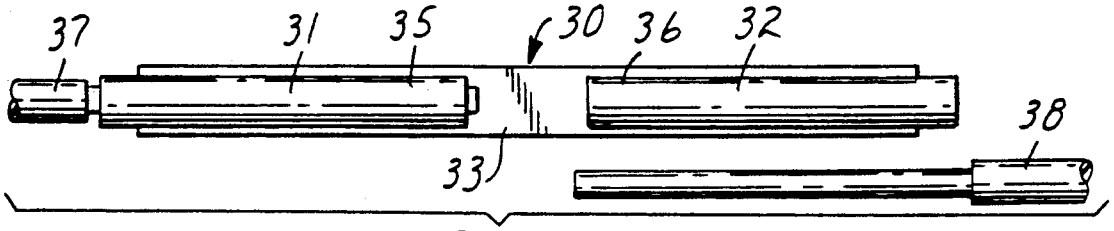
FIG. 6 is a top plan view of a third embodiment of the connector of the present invention together with two wire ends, one of which has been inserted into a cylinder of the connector and the other adjacent the connector.
Figure 6A:
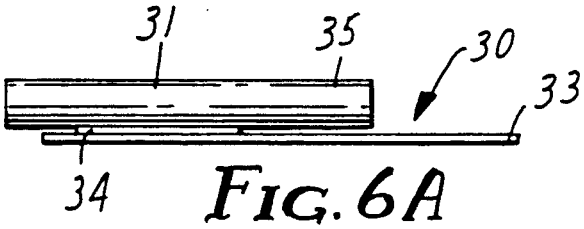
FIG. 6A is a fragmentary side elevational view of the connector of FIG. 6.
Figure 7:
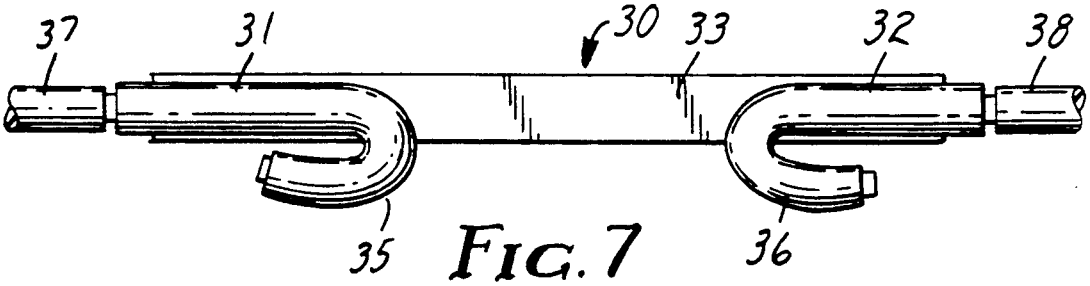
FIG. 7 is a top plan view of the connector of FIG. 6 with the wires connected or spliced together.

Referring now to FIGS. 6 and 6A it will be noted that the connector 30 is comprised of two hollow cylinders 31 and 32, which are formed of an electrically conductive metal, such as cartridge brass, and that the cylinders 31 and 32 are axially aligned in relationship to one another. A conductive bar 33 extends between the cylinders 31 and 32 and is joined to each cylinder by welding or brazing as at 34 to securely join the two cylinders electrically and mechanically. The bar 33 is joined to the cylinders along a length of each cylinder, a wire entrance end of each cylinder, to provide an end portion 35 and 36, respectively of the cylinder which is free of the bar to permit the end portion to be bent transversely of the bar through an angle sufficient to secure a wire in the cylinder as explained above. An angle of about 180° reduces the size of the finished splice and assures good electrical contact and strain relief on the wire. The connector 30 of FIG. 6 is a convenient way of splicing together two wires 37 and 38 which have been accidently cut. The connector 30 eliminates the need, in most such cases, of splicing in additional wire to make an effective connection, that is when the cut takes place in a wire placed in the ground or extending between two poles, and there is no way of pulling any slack in the wires to apply a spring connector or wire nut on the ends of the wires. The connector 30, with the bar 33 provided the added length needed to splice the wires, and the connector restores the wire strength at the splice.

Figure 8:
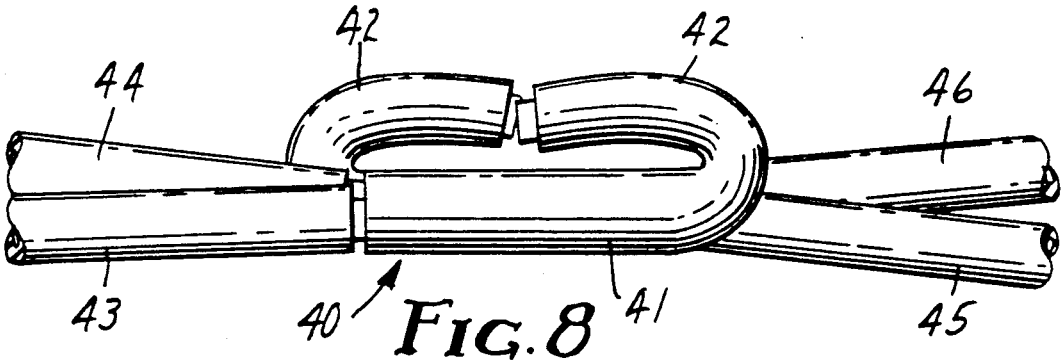
FIG. 8 is a side elevational view of a connector joining four wires together as may be required in a wire hardness.
Figure 9:
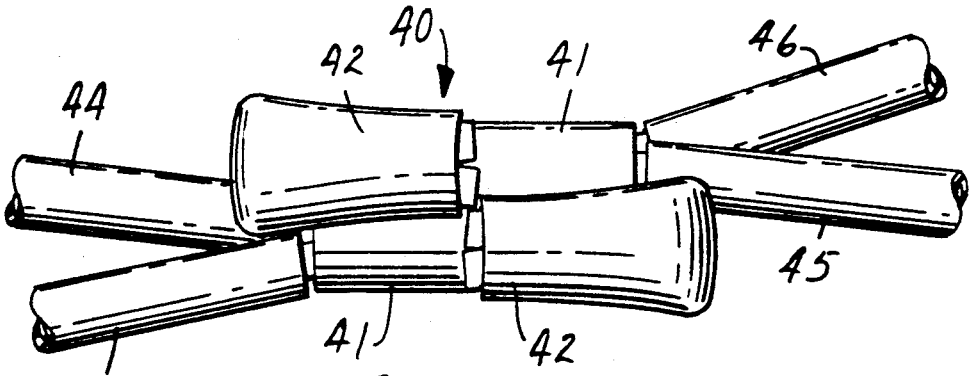
FIG. 9 is a top plan view of the connector of FIG. 8 with the wires spliced together.

FIG. 8 shows another embodiment of a connector 40, similar to the connector 10, with the cylinders 41 of a size, and generally of oval shape, in cross-section to receive two pair of wires 43 and 44, and 45 and 46, respectively. This connector is provided with a weldment afforded by brazing the cylinders together to form the two cylinders in fixed relationship with each cylinder having end 42. A pair of wires is placed in the entrance end of one or both cylinders as illustrated and the free end portion 42 of each cylinder is bent in an arc sufficient to grip both of the wires 43, 44 and 45, 46 in the respective cylinder 41, as illustrated in FIGS. 8 and 9.

The uniqueness of the invention lies in the unexpected powerful gripping action which is developed upon formation of the bend in the cylinder against the wire. The pressures generated during bending are, as mentioned previously, sufficient to penetrate the protective insulative shield of a solid wire and establish good metal to metal contact of the wire with the inner surface of the metal cylinder. It is necessary to select material of suitable dimensions, including wall thickness, so that optimum wire retention is achieved. In most cases, the wire in the cylinder is maintained by friction forces and mechanical forces developed by the bending of the wire in a confined space developed by the cylinder. This may be enhanced by flattening the bend to form a strong mechanical and electrical connection but being careful not to break the wire or bend the same about such an arc that the wire is severely weakened at the fold. The gripping action of the bent cylinder may be further enhanced by modifying the section of cylinder at the area in which the bend will occur. For example, holes drilled or slots cut at the point where the cylinder will bend as illustrated in FIG. 8 may be useful for introducing sharp edges. These sharp edges, by cutting into the surface of the wire, may enhance the gripping action of the kinked tube. Other means of modifying the gripping action involve changes in the cross section of the tube where the bend is introduced.

Retention of wires by the tubular connectors is also affected by the metal used to fabricate the tubular connector or the electrical wire. The preferred metals for the tubular connector include aluminum-bronze or cartridge brass. These metals are ductile, of low cost and high strength. They are generally favored over the use of copper components when copper wires are to be joined.

Following the formation of an electrical connection using a cylindrical tube according to this invention, it may be desirable to protect said connection using suitable insulating material. This may be achieved using well known methods of electrical insulation. For instance, an electrically insulating tape provides a low cost versatile way to protect the electrical connection. As an alternative a heat-shrink insulating sleeve may also be used. These examples are not intended to be limiting. Other means of insulation will be apparent to those skilled in providing insulated connections.

Tubing of suitable material and dimensions is produced by drawing the metal. The resulting tube is cut into required lengths, 2.54 cm to 5 cm, deburred and plated. In the production of a simple two-wire connector two sections of tubing, generally of equal length, are bonded together as by welding or brazing in the parallel configuration illustrated in FIGS. 1 and 4. Bonding of the two cylinders is accomplished by brazing or welding a bead or bridge between the cylinders. The weldment is normally connected towards one end of each tube leaving a portion of each cylinder free of the connection between cylinders. The cylinders are in parallel or aligned relationship on opposite sides of the bridging connection therebetween.

Having described the present invention in reference to several embodiments thereof, it is to be understood that other specific embodiments may be developed without departing from the spirit or scope of the invention as defined by the appended claims.

I claim:

1. A connector for joining a plurality of wires comprising a body having:

a pair of hollow cylinders formed of a ductile electrically conductive metal material, said cylinders having an inside diameter to receive an end of at least one wire, to be joined to another wire; and said cylinders being disposed parallel to each other and joined electrically and mechanically, each cylinder having a wire entrance end disposed adjacent the area the cylinders are joined mechanically and an end portion free of said mechanical connection and of sufficient length to permit the same to be bent back upon the cylinder whereby said free end portions may be folded to make intimate contact with a said wire disposed in said free end portions of said cylinders and make an electrical connection therebetween.

2. A connector according to claim 1 wherein said cylinders are positioned parallel to each other and are offset axially to form the free end portions, and said cylinders are joined along the length of the portions of the cylinders in juxtaposition.

3. A connector according to claim 1 wherein said cylinders are aligned axially with each other and said cylinders are joined by an electrically conductive bar positioned between said cylinders and electrically connected thereto.

4. A connector according to claim 3 wherein the adjacent ends of the axially aligned cylinders are said free end portions and free from connection with said conductive bar.

5. A method of connecting the ends of a pair of wires electrically comprising the steps of:

providing a pair of hollow cylinders formed of an electrically conductive metallic material, which are joined together such that end portions of the cylinders are free from each other;

placing the ends of two wires to be joined in the cylinders such that the ends of the wires extend into said end portions; and bending the end portions and the wire ends disposed therein about an arc sufficient to bend the end portion of the cylinder in relationship to the remaining portion of the cylinder to form a kink n the cylinder and bind the wire ends therein.

* * * * *